US011745979B2

(12) United States Patent
Abe et al.

(10) Patent No.: US 11,745,979 B2
(45) Date of Patent: Sep. 5, 2023

(54) DIAGNOSTIC DEVICE AND DIAGNOSTIC ANALYSIS DEVICE FOR VERTICAL TRANSPORTATION DEVICES

(71) Applicant: Mitsubishi Electric Building Solutions Corporation, Tokyo (JP)

(72) Inventors: Masaya Abe, Tokyo (JP); Takeshi Fujita, Tokyo (JP); Takumi Oda, Tokyo (JP)

(73) Assignee: MITSUBISHI ELECTRIC BUILDING SOLUTIONS CORPORATION, Tokyo (JP)

( * ) Notice: Subject to any disclaimer, the term of this patent is extended or adjusted under 35 U.S.C. 154(b) by 0 days.

(21) Appl. No.: 17/796,677

(22) PCT Filed: Feb. 7, 2020

(86) PCT No.: PCT/JP2020/004967
§ 371 (c)(1),
(2) Date: Aug. 1, 2022

(87) PCT Pub. No.: WO2021/157086
PCT Pub. Date: Aug. 12, 2021

(65) Prior Publication Data

US 2023/0056746 A1 Feb. 23, 2023

(51) Int. Cl.
*B66B 5/00* (2006.01)
*B66B 1/34* (2006.01)

(52) U.S. Cl.
CPC ..... *B66B 5/0018* (2013.01); *B66B 1/3461* (2013.01); *B66B 1/3492* (2013.01)

(58) Field of Classification Search
CPC ..... B66B 1/3492; B66B 5/00; B66B 5/0006; B66B 5/0037; B66B 5/02; B66B 5/04; B66B 11/02; B66B 11/0226
See application file for complete search history.

(56) References Cited

U.S. PATENT DOCUMENTS 7,703,579 B2 * 4/2010 Tyni ..... B66B 5/0025 187/316
11,498,811 B2 * 11/2022 Durand ..... B66B 5/0087
(Continued)

FOREIGN PATENT DOCUMENTS

CN 106395534 A 2/2017
CN 107585666 A 1/2018
(Continued)

OTHER PUBLICATIONS

International Search Report and Written Opinion dated Mar. 10, 2020, received for PCT Application PCT/JP2020/004967, filed on Feb. 7, 2020, 13 pages including English Translation.
(Continued)

*Primary Examiner* — Christopher Uhlir
(74) *Attorney, Agent, or Firm* — XSENSUS LLP

(57) ABSTRACT

There is provided a diagnostic device for vertical transportation devices, which can obtain information for appropriately diagnosing a vertical transportation device. The diagnostic device for vertical transportation devices includes a housing-unit that defines an outer profile, a storage-unit that is housed in the housing-unit and stores information, an acceleration-detection-unit that is housed in the housing-unit and detects, with the housing-unit attached to a moving object in the vertical transportation device, acceleration in a vertical direction and acceleration in a horizontal direction of the moving object as diagnostic information of the moving object in the vertical transportation device when the moving object has moved, and a control-unit that is housed in the housing-unit and causes the storage-unit to store information about the acceleration in the vertical direction and information about the acceleration in the horizontal direction, which have been detected by the acceleration-
(Continued)

detection-unit, in association with information about a detection timing.

10 Claims, 7 Drawing Sheets

(56) References Cited

U.S. PATENT DOCUMENTS

| | | | | |
|---|---|---|---|---|
| 2018/0332368 | A1 | 11/2018 | Copeland et al. | |
| 2020/0031619 | A1* | 1/2020 | Sudi | B66B 9/00 |
| 2022/0164488 | A1* | 5/2022 | Cortona | G06F 30/13 |
| 2022/0297976 | A1* | 9/2022 | Studer | B66B 1/3407 |
| 2022/0380179 | A1* | 12/2022 | Hutchinson | B66B 1/3461 |

FOREIGN PATENT DOCUMENTS

| | | | |
|---|---|---|---|
| CN | 108557603 | A | 9/2018 |
| CN | 110342363 | A | 10/2019 |
| DE | 102015101634 | A1 | 8/2015 |
| EP | 3424860 | A1 | 1/2019 |
| JP | 2014-105075 | A | 6/2014 |
| JP | 2015-168560 | A | 9/2015 |
| JP | 2018-111579 | A | 7/2018 |
| JP | 2019-189445 | A | 10/2019 |
| WO | 2015/118064 | A1 | 8/2015 |
| WO | 2017/093438 | A1 | 6/2017 |
| WO | 2019/002011 | A1 | 1/2019 |

OTHER PUBLICATIONS

Notice of Reasons for Refusal dated Apr. 5, 2022, received for PCT Application 2021-575580, 6 pages including English Translation.
Decision to Grant dated Jun. 28, 2022, received for PCT Application 2021-575580, 5 pages including English Translation.
Notice of Reasons for Refusal dated Apr. 5, 2022, received for JP Application 2021-575580, 6 pages including English Translation.
Decision to Grant dated Jun. 28, 2022, received for JP Application 2021-575580, 5 pages including English Translation.
Office Action dated May 25, 2023 in the corresponding German patent application No. 11 2020 006 689.4, 16 pages.

* cited by examiner

DIAGNOSTIC DEVICE AND DIAGNOSTIC ANALYSIS DEVICE FOR VERTICAL TRANSPORTATION DEVICES

CROSS-REFERENCE TO RELATED APPLICATION

The present application is based on PCT filing PCT/JP2020/004967, filed Feb. 7, 2020, the entire contents of which is incorporated herein by reference.

FIELD

The present disclosure relates to a diagnostic device and a diagnostic analysis device for vertical transportation devices.

BACKGROUND

PTL 1 discloses a method for measuring vibration or noise of an elevator. The method for measuring vibration or noise makes it possible to simply perform work for measuring vibration or noise.

CITATION LIST

Patent Literature

[PTL 1] JP 2015-168560 A

SUMMARY

Technical Problem

However, in the method for measuring vibration or noise described in PTL 1, vibration or noise is only measured. Accordingly, a vertical transportation device cannot be appropriately diagnosed.

The present disclosure has been made to solve the above-described problem. An object of the present disclosure is to provide a diagnostic device and a diagnostic analysis device for vertical transportation devices, either of which can obtain information for appropriately diagnosing the vertical transportation devices.

Solution to Problem

A diagnostic device for vertical transportation devices according to the present disclosure includes a housing unit defining an outer profile, a storage unit housed in the housing unit and configured to store information, an acceleration detection unit housed in the housing unit and configured to detect, with the housing unit attached to a moving object in a vertical transportation device, acceleration in a vertical direction and acceleration in a horizontal direction of the moving object as diagnostic information of the moving object in the vertical transportation device when the moving object has moved, and a control unit housed in the housing unit and configured to cause the storage unit to store information about the acceleration in the vertical direction and information about the acceleration in the horizontal direction, which have been detected by the acceleration detection unit, in association with information about a detection timing.

A diagnostic analysis device for vertical transportation devices according to the present disclosure includes an analysis-side reception unit configured to receive information, an accumulation unit configured to accumulate the information, and an analysis unit configured to cause, when the analysis-side reception unit receives diagnostic information from the diagnostic device, the accumulation unit to accumulate the diagnostic information and to analyze diagnostic information of a moving object in a vertical transportation device based on the accumulated diagnostic information.

Advantageous Effects of Invention

According to the present disclosure, the diagnostic device detects acceleration in a vertical direction and acceleration in a horizontal direction of a moving object in a vertical transportation device when the moving object has moved with the diagnostic device attached to the moving object. The diagnostic device stores information about the acceleration in the vertical direction and information about the acceleration in the horizontal direction of the moving object in association with information about a detection timing. Accordingly, information for appropriately diagnosing the vertical transportation device can be obtained.

DESCRIPTION OF EMBODIMENTS

Figure 1:
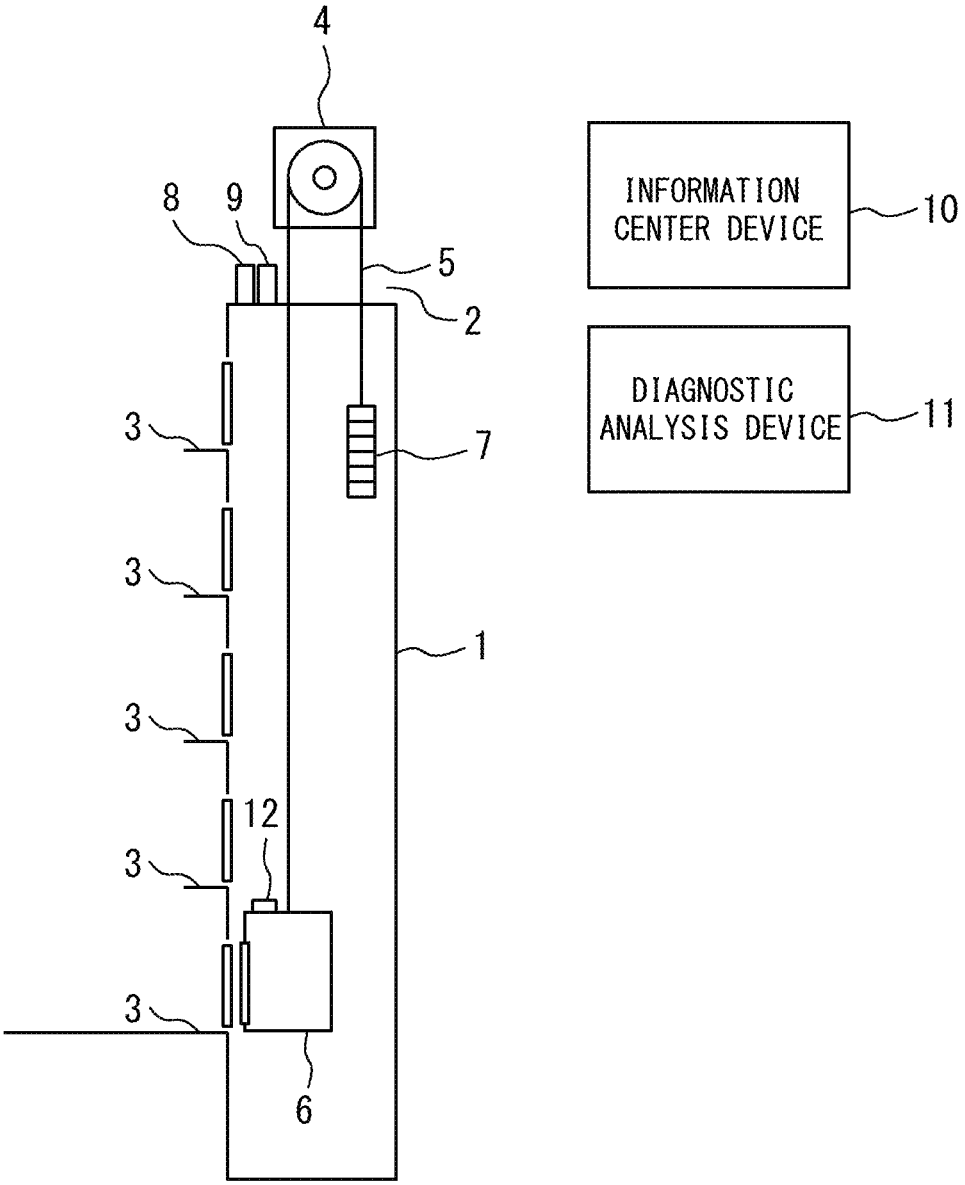
FIG. 1 is a block diagram of an elevator system to which a diagnostic analysis device for vertical transportation devices in an embodiment 1 is applied.

An embodiment will be described with reference to the accompanying drawings. Identical or corresponding portions are assigned the same reference numerals in the figures. Overlapping description of the portions is appropriately simplified or omitted.

Embodiment 1

FIG. 1 is a block diagram of an elevator system to which a diagnostic analysis device for vertical transportation devices in an embodiment 1 is applied.

In the elevator system illustrated in FIG. 1, a shaft 1 penetrates each of floors of a building not illustrated. A machine room 2 is provided just above the shaft 1. A plurality of halls 3 are respectively provided on the floors of the building. Each of the plurality of halls 3 opposes the shaft 1.

A traction machine 4 is provided in the machine room 2. A main rope 5 is wound around the traction machine 4.

A car 6 is provided in the shaft 1. The car 6 is supported on one side of the main rope 5. A counter weight 7 is provided in the shaft 1. The counter weight 7 is supported on the other side of the main rope 5.

A control device 8 is provided in the machine room 2. The control device 8 is provided to be able to entirely control an elevator.

A monitoring device 9 is provided in the machine room 2. The monitoring device 9 is provided to be able to monitor a condition of the elevator based on information from the control device 8.

An information center device 10 is provided in a place spaced apart from the building provided with the elevator. For example, the information center device 10 is provided in a maintenance company of the elevator. The information center device 10 is provided to be able to grasp the condition of the elevator based on information from the monitoring device 9.

A diagnostic analysis device 11 is provided in a place spaced apart from the building provided with the elevator. For example, the diagnostic analysis device 11 is provided in the maintenance company of the elevator. The diagnostic analysis device 11 is provided to be able to analyze vibration, noise, an image, and the like of the elevator.

When the elevator is diagnosed, a portable terminal 12 such as a smartphone is attached to the car 6 as a diagnostic device. In this state, the portable terminal 12 collects information about vibration of the car 6, a sound around the car 6, an image around the car 6, and the like as diagnostic information.

Then, a method for diagnosing the elevator system will be described with reference to FIG. 2.

Figure 2:
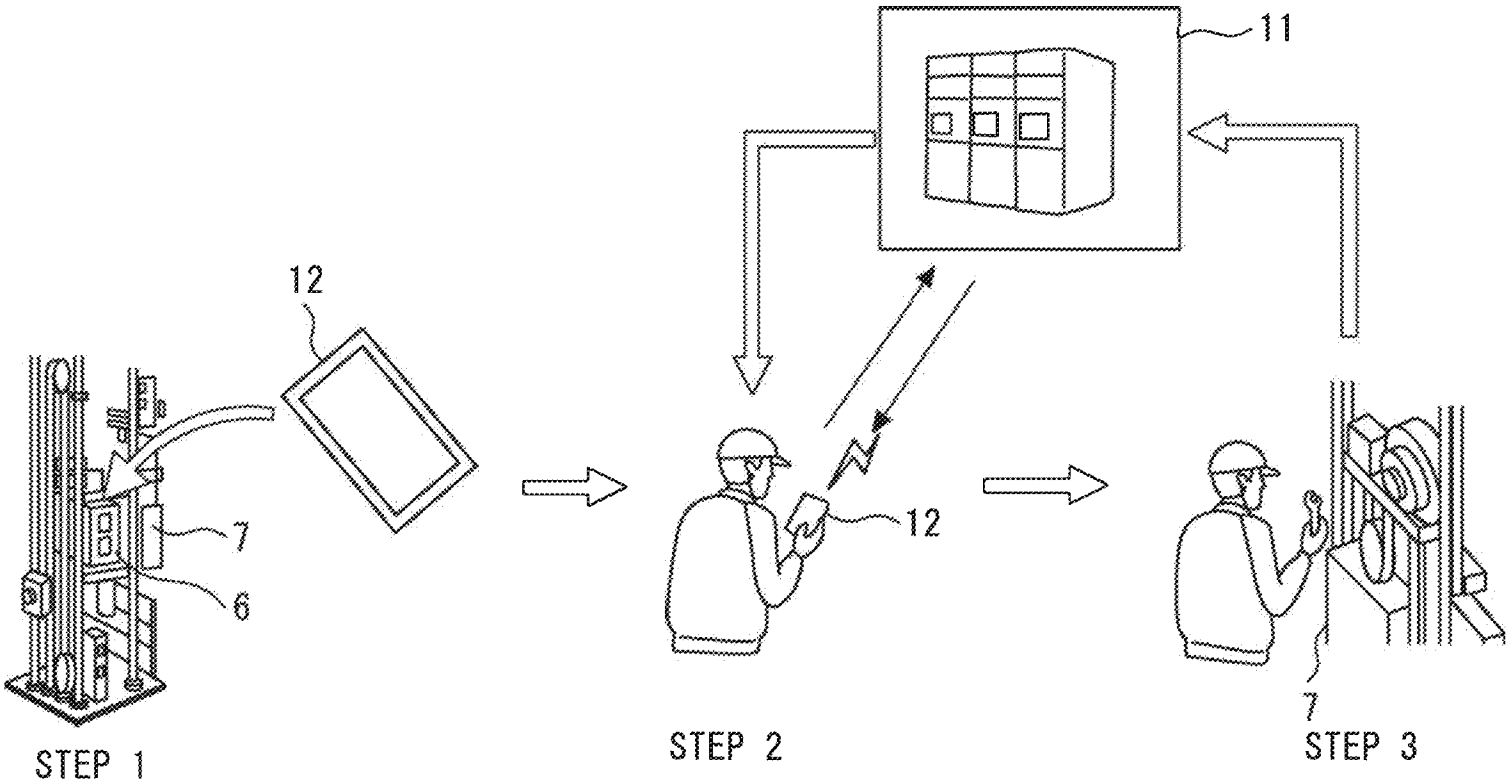
FIG. 2 is a diagram for describing a method for diagnosing the elevator system to which the diagnostic analysis device for vertical transportation devices in the embodiment 1 is applied.

FIG. 2 is a diagram for describing a method for diagnosing the elevator system to which the diagnostic analysis device for vertical transportation devices in the embodiment 1 is applied.

As illustrated in STEP 1 of FIG. 2, the portable terminal 12 is temporarily attached in a previously set direction in an inner portion or a ceiling portion of the car 6. In this state, the car 6 travels by a test operation. In this case, the portable terminal 12 collects diagnostic information.

After the test operation of the car 6, the portable terminal 12 is recovered by a maintenance person, as illustrated in STEP 2 of FIG. 2. Then, the portable terminal 12 receives information required to diagnose the elevator from the diagnostic analysis device 11 based on an operation by the maintenance person. For example, the portable terminal 12 receives information about a reference value when determining whether or not vibration, noise, or the like is permitted.

Then, the portable terminal 12 diagnoses the elevator based on the operation by the maintenance person. For example, the portable terminal 12 determines whether or not a detection value of the vibration, the noise, or the like exceeds the reference value. Then, the portable terminal 12 displays a diagnosis result of the elevator based on the operation by the maintenance person. For example, the portable terminal 12 indicates whether or not the vibration, the noise, or the like is permitted.

Then, the maintenance person performs required maintenance depending on the diagnosis result of the elevator, as illustrated in STEP 3 of FIG. 2. Then, the portable terminal 12 is temporarily attached in a previously set direction in the inner portion or the ceiling portion of the car 6. In this state, the car 6 travels by a test operation. In this case, the portable terminal 12 collects diagnostic information. Then, the portable terminal 12 diagnoses the elevator based on an operation by the maintenance person. Then, the portable terminal 12 displays a diagnosis result of the elevator based on an operation by the maintenance person. Then, the portable terminal 12 registers information about the diagnosis result of the elevator in association with identification information of the elevator based on an operation by the maintenance person.

If detailed diagnosis is required, the portable terminal 12 transmits the diagnostic information and the identification information of the elevator in association with each other toward the diagnostic analysis device 11 based on an operation by the maintenance person. The diagnostic analysis device 11 performs detailed diagnosis for the diagnostic information. For example, the diagnostic analysis device 11 extracts a plurality of pieces of diagnostic information for an elevator similar to the elevator among a large number of accumulated diagnostic information based on the identification information. The diagnostic analysis device 11 performs detailed diagnosis for the diagnostic information based on the plurality of pieces of extracted diagnostic information. Then, the diagnostic analysis device 11 transmits information representing a result obtained by the detailed diagnosis toward the portable terminal 12. The portable terminal 12 displays the information representing the result obtained by the detailed diagnosis.

Then, the diagnostic analysis device 11 and the portable terminal 12 will be described with reference to FIG. 3.

Figure 3:
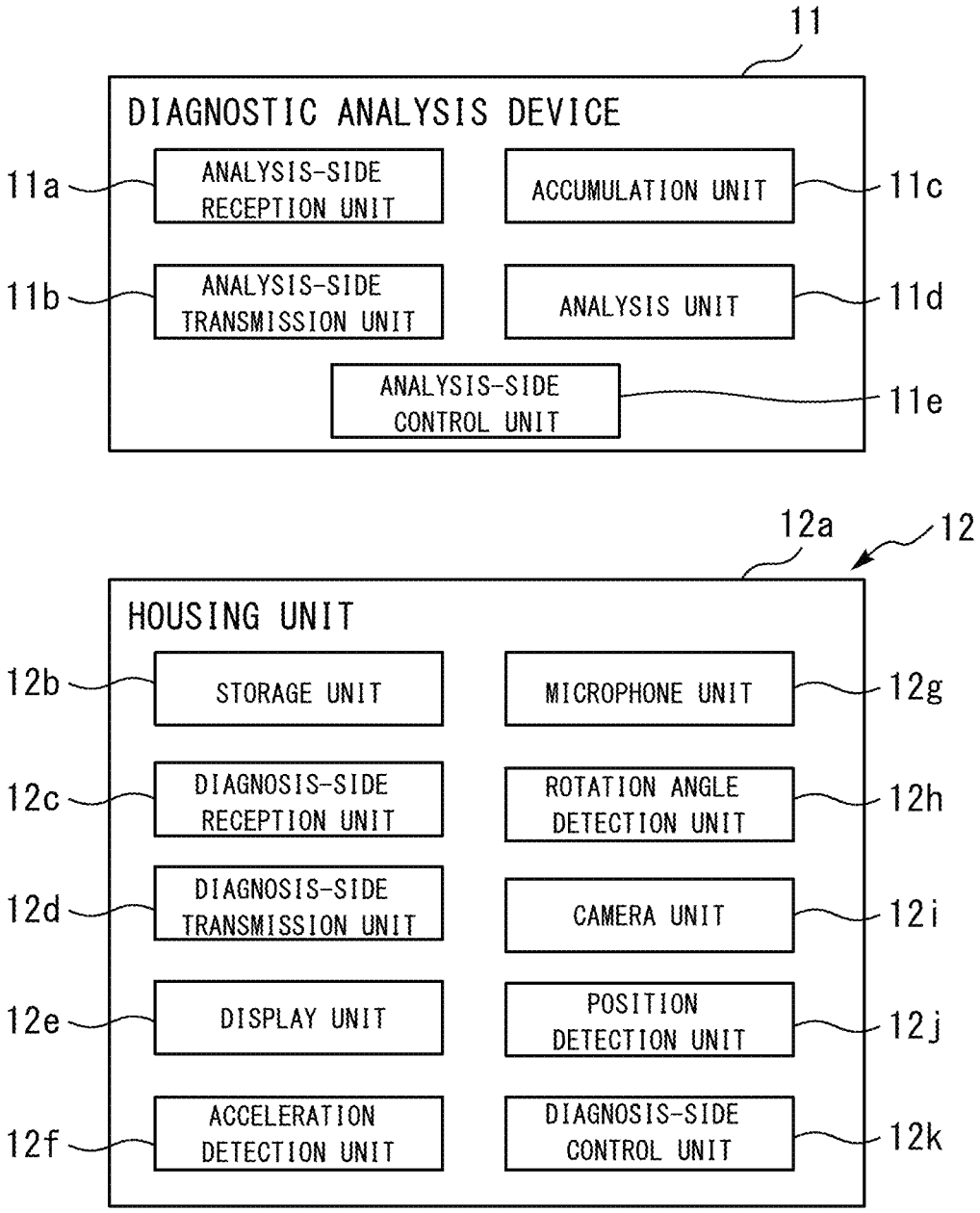
FIG. 3 is a block diagram of the diagnostic analysis device for vertical transportation devices and a portable terminal as a diagnostic device in the embodiment 1.

FIG. 3 is a block diagram of the diagnostic analysis device for vertical transportation devices and the portable terminal as the diagnostic device in the embodiment 1.

As illustrated in FIG. 3, the diagnostic analysis device 11 includes an analysis-side reception unit 11*a*, an analysis-side transmission unit 11*b*, an accumulation unit 11*c*, an analysis unit 11*d*, and an analysis-side control unit 11*e*.

The analysis-side reception unit 11*a* is provided to be able to receive information. For example, the analysis-side reception unit 11*a* receives information from the portable terminal 12.

The analysis-side transmission unit 11*b* is provided to be able to transmit information. For example, the analysis-side transmission unit 11*b* transmits information toward the portable terminal 12.

The accumulation unit 11*c* is provided to be able to accumulate information. For example, the accumulation unit 11*c* accumulates, every time the analysis-side reception unit 11*a* receives diagnostic information and identification information of the elevator from the portable terminal 12, the diagnostic information and the identification information of the elevator in association with each other.

The analysis unit 11*d* is provided to be able to analyze diagnostic information of the elevator to perform detailed diagnosis of the elevator. For example, the analysis unit 11*d* analyzes, based on a plurality of pieces of diagnostic information accumulated in the accumulation unit 11*c*, the diagnostic information received by the analysis-side reception unit 11*a*.

The analysis-side control unit 11*e* is provided to be able to control the analysis-side reception unit 11*a*, the analysis-side transmission unit 11*b*, the accumulation unit 11*c*, and the analysis unit 11*d*. For example, the analysis-side control unit 11*e* resamples, when the analysis-side reception unit 11*a* receives diagnostic information from the portable terminal 12, the diagnostic information, and then causes the accumulation unit 11*c* to accumulate the resampled diagnostic information. For example, the analysis-side control unit 11*e* resamples, when the analysis-side reception unit 11*a* receives diagnostic information from the portable terminal 12, the diagnostic information, and then causes the analysis unit 11*d* to analyze the resampled diagnostic information. For example, the analysis-side control unit 11*e* causes the analysis-side transmission unit 11*b* to transmit information representing an analysis result by the analysis unit 11*d* toward the portable terminal 12.

As illustrated in FIG. 3, the portable terminal 12 includes a housing unit 12*a*, a diagnosis-side reception unit 12*c*, a diagnosis-side transmission unit 12*d*, a storage unit 12*b*, a display unit 12*e*, an acceleration detection unit 12*f*, a microphone unit 12*g*, a rotation angle detection unit 12*h*, a camera unit 12*i*, a position detection unit 12*j*, and a diagnosis-side control unit 12*k*.

The housing unit 12*a* defines an outer profile of the portable terminal 12. For example, the housing unit 12*a* is formed into a rectangular shape.

The storage unit 12*b* is housed in the housing unit 12*a*. The storage unit 12*b* is provided to be able to store information. For example, the storage unit 12*b* stores information required to diagnose the elevator. For example, the storage unit 12*b* stores diagnostic information. For example, the storage unit 12*b* stores identification information of the elevator.

The diagnosis-side reception unit 12*c* is housed in the housing unit 12*a*. The diagnosis-side reception unit 12*c* is provided to be able to receive information. For example, the diagnosis-side reception unit 12*c* receives information from the diagnostic analysis device 11.

The diagnosis-side transmission unit 12*d* is housed in the housing unit 12*a*. The diagnosis-side transmission unit 12*d* is provided to be able to transmit information. For example, the diagnosis-side transmission unit 12*d* transmits information toward the diagnostic analysis device 11.

The display unit 12*e* is housed in the housing unit 12*a*. The display unit 12*e* is provided to be able to display information. For example, the display unit 12*e* displays diagnostic information, for example, information representing a diagnosis result.

The acceleration detection unit 12*f* is housed in the housing unit 12*a*. The acceleration detection unit 12*f* is provided to be able to detect acceleration. For example, the acceleration detection unit 12*f* detects respective accelerations of three axes perpendicular to one another.

The microphone unit 12*g* is housed in the housing unit 12*a*. The microphone unit 12*g* is provided to be able to collect a sound around the housing unit 12*a*.

The rotation angle detection unit 12*h* is housed in the housing unit 12*a*. The rotation angle detection unit 12*h* is provided to be able to detect a rotation angle. For example, the rotation angle detection unit 12*h* detects respective rotation angles of the three axes perpendicular to one another.

The camera unit 12*i* is housed in the housing unit 12*a*. The camera unit 12*i* is provided to be able to shoot the periphery of the housing unit 12*a*. For example, the camera unit 12*i* shoots the periphery on the front surface side and the periphery on the rear surface side of the housing unit 12*a*.

The position detection unit 12*j* is housed in the housing unit 12*a*. The position detection unit 12*j* is provided to be able to detect a position of the housing unit 12*a*. For example, the position detection unit 12*j* detects the position of the housing unit 12*a* by a function of a global positioning system.

The diagnosis-side control unit 12*k* is housed in the housing unit 12*a*. The diagnosis-side control unit 12*k* is provided to be able to control the diagnosis-side reception unit 12*c*, the diagnosis-side transmission unit 12*d*, the display unit 12*e*, the acceleration detection unit 12*f*, the microphone unit 12*g*, the rotation angle detection unit 12*h*, the camera unit 12*i*, and the position detection unit 12*j*.

For example, the diagnosis-side control unit 12*k* causes the storage unit 12*b* to store information about acceleration in a vertical direction and information about acceleration in a horizontal direction, which have been detected by the acceleration detection unit 12*f*, in association with information about a detection timing such as a sampling cycle.

For example, the diagnosis-side control unit 12*k* causes the storage unit 12*b* to store information corresponding to the sound detected by the microphone unit 12*g* in association with the information about the detection timing such as the sampling cycle.

For example, the diagnosis-side control unit 12*k* causes the storage unit 12*b* to store information about rotation angle detected by the rotation angle detection unit 12*h* in association with the information about the detection timing such as the sampling cycle.

For example, the diagnosis-side control unit 12*k* causes the storage unit 12*b* to store information about an image shot by the camera unit 12*i* in association with information about a shooting timing such as a sampling cycle.

For example, the diagnosis-side control unit 12*k* determines a direction of the housing unit 12*a* relative to the car 6 based on the information about the image shot by the camera unit 12*i*.

For example, the diagnosis-side control unit 12*k* causes the display unit 12*e* to display information about a position in a vertical direction of the car 6 obtained from the information about the acceleration in the vertical direction detected by the acceleration detection unit 12*f* and other diagnostic information in association with each other.

For example, the diagnosis-side control unit 12*k* causes the diagnosis-side transmission unit 12*d* to transmit diagnostic information of the car 6 toward the diagnostic analysis device 11.

Then, an example of display of the portable terminal 12 will be described with reference to FIGS. 4A, 4B and 4C.

Figure 4A:
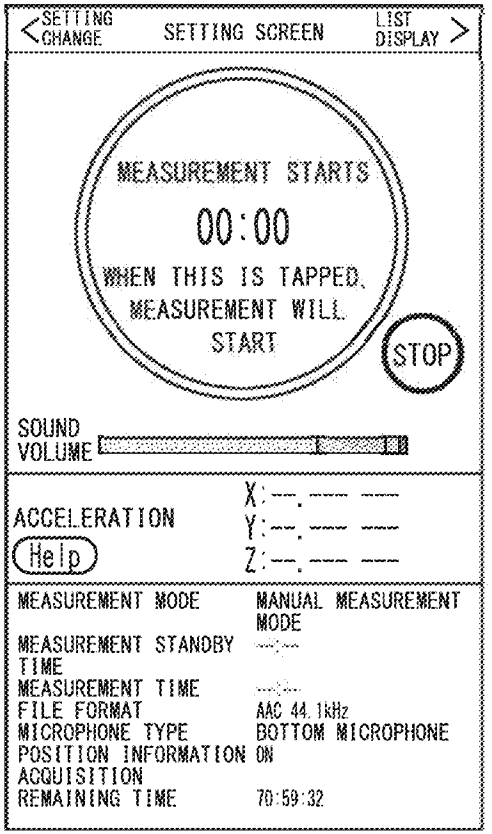
FIG. 4A is a diagram illustrating an example of an initial screen of application software to be used to diagnose the elevator.
Figure 4B:
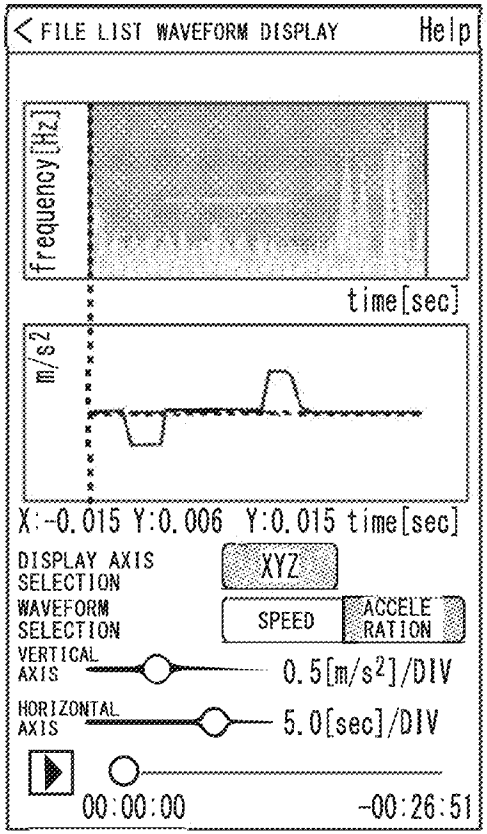
FIG. 4B is a diagram illustrating a first example of display of diagnostic information.
Figure 4C:
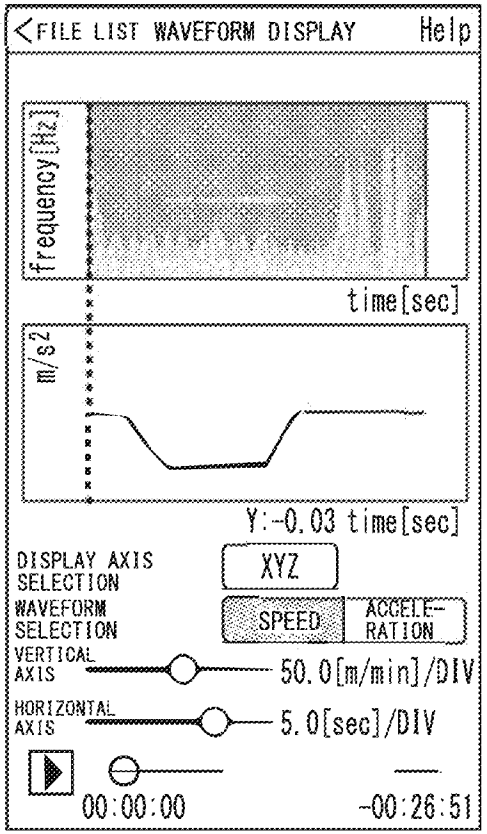
FIG. 4C is a diagram illustrating a second example of display of the diagnostic device.

FIGS. 4A, 4B and 4C are diagrams illustrating an example of display of the portable terminal as the diagnostic device to be used when the elevator system to which the diagnostic analysis device for vertical transportation devices in the embodiment 1 is applied is diagnosed.

FIG. 4A illustrates an example of an initial screen of application software to be used to diagnose the elevator. FIG. 4B illustrates a first example of display of diagnostic information. FIG. 4C illustrates a second example of display of the diagnostic device.

As illustrated in FIG. 4A, "measurement start", "stop", and "sound volume" are displayed in an upper portion of the initial screen.

"Measurement start" is a region to be touched when starting to collect diagnostic information of the elevator. When the region has been touched, the portable terminal 12 starts to collect the diagnostic information of the elevator.

"Stop" is a region to be touched when finishing collecting the diagnostic information of the elevator. When the region has been touched, the portable terminal 12 finishes collecting the diagnostic information of the elevator.

"Sound volume" is a region where information corresponding to a sound detected by the microphone unit 12*g* is displayed. On the region, the information corresponding to the sound detected by the microphone unit 12*g* is displayed in real time.

As illustrated in FIG. 4A, "acceleration" is displayed in a central portion of the initial screen. "Acceleration" is a region where information about acceleration detected by the acceleration detection unit 12*f* is displayed. On the region, information about acceleration in an X-axis direction, information about acceleration in a Y-axis direction, and information about acceleration in a Z-axis direction, which have been detected by the acceleration detection unit 12*f*, are displayed in real time.

As illustrated in FIG. 4A, a setting situation is displayed in a lower portion of the initial screen. The setting situation is a region where information about a plurality of setting items in the application software is displayed. On the region, "measurement mode", "measurement standby time", "measurement time", "file format", "microphone type", "position information acquisition", and "remaining time", for example, are displayed as the information about the plurality of setting items.

Examples of "measurement mode" include "manual mode" and "timer mode". If "manual mode" is selected, measurement is started when the maintenance person has touched the region "measurement start" and is finished when the maintenance person has touched the region "stop". If "timer mode" is selected, when the maintenance person has touched the region "measurement start", measurement is started when previously set "measurement standby time" elapses and is finished when previously set "measurement time" elapses. For example, a plurality of pieces of specific information respectively corresponding to "file format", "microphone type", "position information acquisition", and "remaining time" are also displayed.

As illustrated in FIG. 4B, information corresponding to a sound is displayed in an upper portion of a first example. In a central portion of the first example, information about acceleration is displayed. "Waveform selection" is a region to be touched when selecting which of "speed" and "acceleration" is to be displayed. "Display axis selection" is a region to be touched when an axis to be displayed is selected. "Display axis selection" can be selected from among "XYZ", "XY", "XZ", "YZ", "X", "Y", and "Z", for example. In this figure, "XYZ" is selected as "display axis selection", and the acceleration in the X-axis direction, the acceleration in the Y-axis direction, and the acceleration in the Z-axis direction are simultaneously displayed. In a lower portion of the first example, "vertical axis button", "horizontal axis button", and "display button" are displayed. "Vertical axis button" and "horizontal axis button" are regions to be touched when a scale of a vertical axis of a waveform to be displayed in the central portion and a scale of a horizontal axis of the waveform to be displayed in the central portion are adjusted. The maintenance person touches and moves right and left "vertical axis button" or "horizontal axis button" to adjust the scale of the horizontal axis or the vertical axis of the waveform to be displayed in the central portion. "Operation button" is a region to be touched when "playback", "stop", "fast forward", "rewind", or the like of a waveform image to be displayed in the central portion is performed. The maintenance person touches "operation button", to operate "playback", "stop", "fast forward", "rewind", or the like of the waveform image to be displayed in the central portion.

As illustrated in FIG. 4C, information corresponding to a sound is displayed in an upper portion of a second example. In a central portion of the second example, "Z" in "display axis selection" is selected, and information about a speed obtained from the acceleration in the Z-axis direction is displayed. In a lower portion of the second example, "vertical axis button", "horizontal axis button", and "operation button" are displayed, like in the first example.

Then, an outline of an operation of the portable terminal 12 will be described with reference to FIG. 5.

Figure 5:
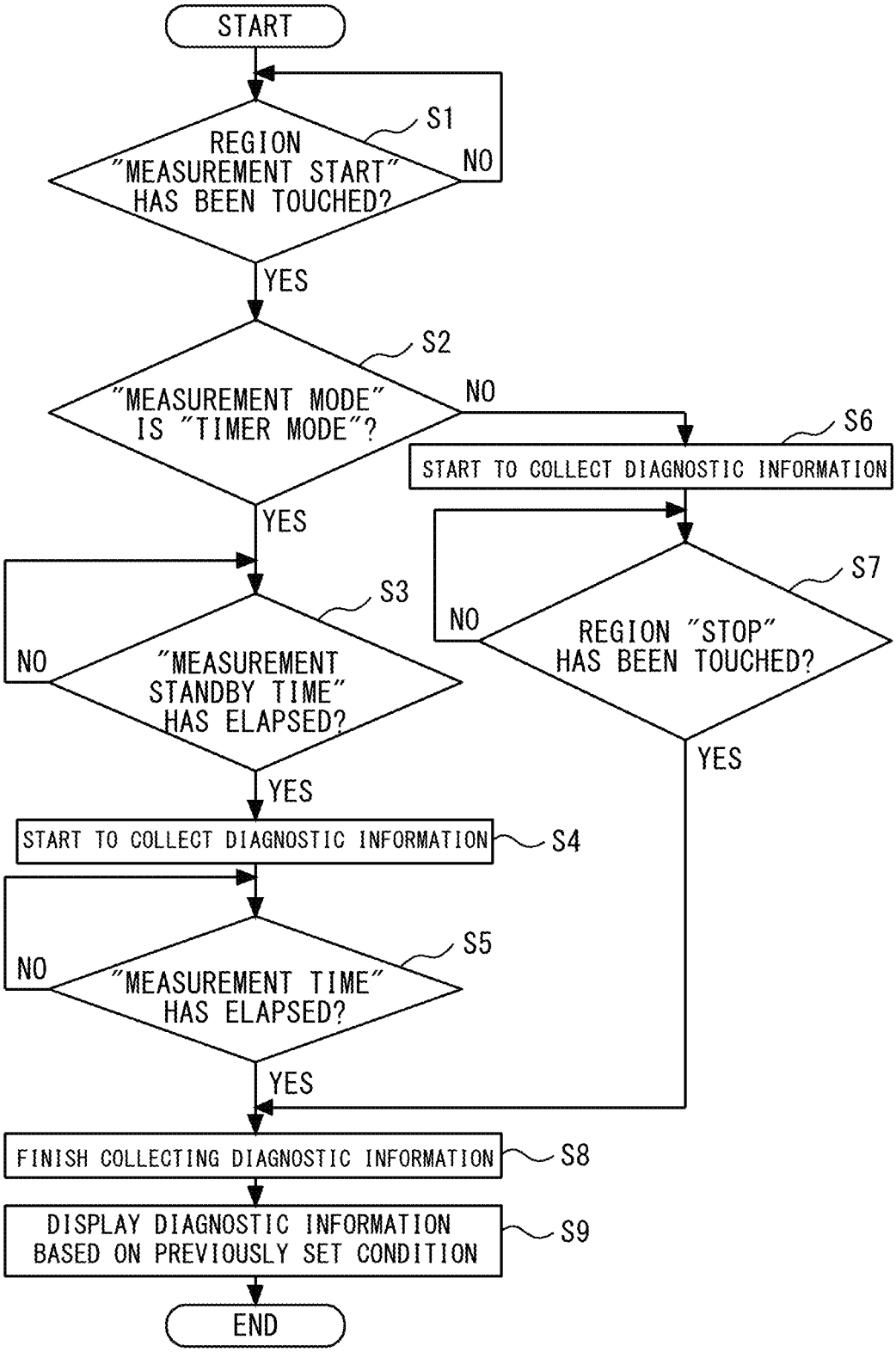
FIG. 5 is a flowchart for describing an outline of an operation of the portable terminal as the diagnostic device to be used when the elevator system to which the diagnostic analysis device for vertical transportation devices in the embodiment 1 is applied is diagnosed.

FIG. 5 is a flowchart for describing the outline of the operation of the portable terminal as the diagnostic device to be used when the elevator system to which the diagnostic analysis device for vertical transportation devices in the embodiment 1 is applied is diagnosed.

In step S1, the portable terminal 12 determines whether or not a region "measurement start" has been touched. If the region "measurement start" has not been touched in step S1, the portable terminal 12 performs an operation in step S1. If the region "measurement start" has been touched in step S1, the portable terminal 12 performs an operation in step S2.

In step S2, the portable terminal 12 determines whether or not "measurement mode" is "timer mode". If it is determined in step S2 that "measurement mode" is "timer mode", the portable terminal 12 performs an operation in step S3.

In step S3, the portable terminal 12 determines whether or not "measurement standby time" has elapsed. If "measurement standby time" has not elapsed in step S3, the portable terminal 12 performs the operation in step S3. If "measurement standby time" has elapsed in step S3, the portable terminal 12 performs an operation in step S4.

In step S4, the portable terminal 12 starts to collect diagnostic information. Then, the portable terminal 12 performs an operation in step S5.

In step S5, the portable terminal 12 determines whether or not "measurement time" has elapsed. If "measurement time" has not elapsed in step S5, the portable terminal 12 performs the operation in step S5. If "measurement time" has elapsed in step S5, the portable terminal 12 performs the operation in step S8.

On the other hand, if it is determined in step S2 that "measurement mode" is not "timer mode", i.e., "measurement mode" is "manual mode", the portable terminal 12 performs an operation in step S6. In step S6, the portable terminal 12 starts to collect diagnostic information. Then, the portable terminal 12 performs an operation in step S7. In step S7, it is determined whether or not a region "stop" has been touched. If the region "stop" has not been touched in step S7, the portable terminal 12 performs the operation in step S7. If the region "stop" has been touched in step S7, the portable terminal 12 performs the operation in step S8.

In step S8, the portable terminal 12 finishes collecting the diagnostic information. Then, the portable terminal 12 performs an operation in step S9. In step S9, the portable terminal 12 displays the diagnostic information based on a previously set condition. Then, the portable terminal 12 finishes the operation.

Then, an outline of an operation of the diagnostic analysis device 11 will be described with reference to FIG. 6.

Figure 6:
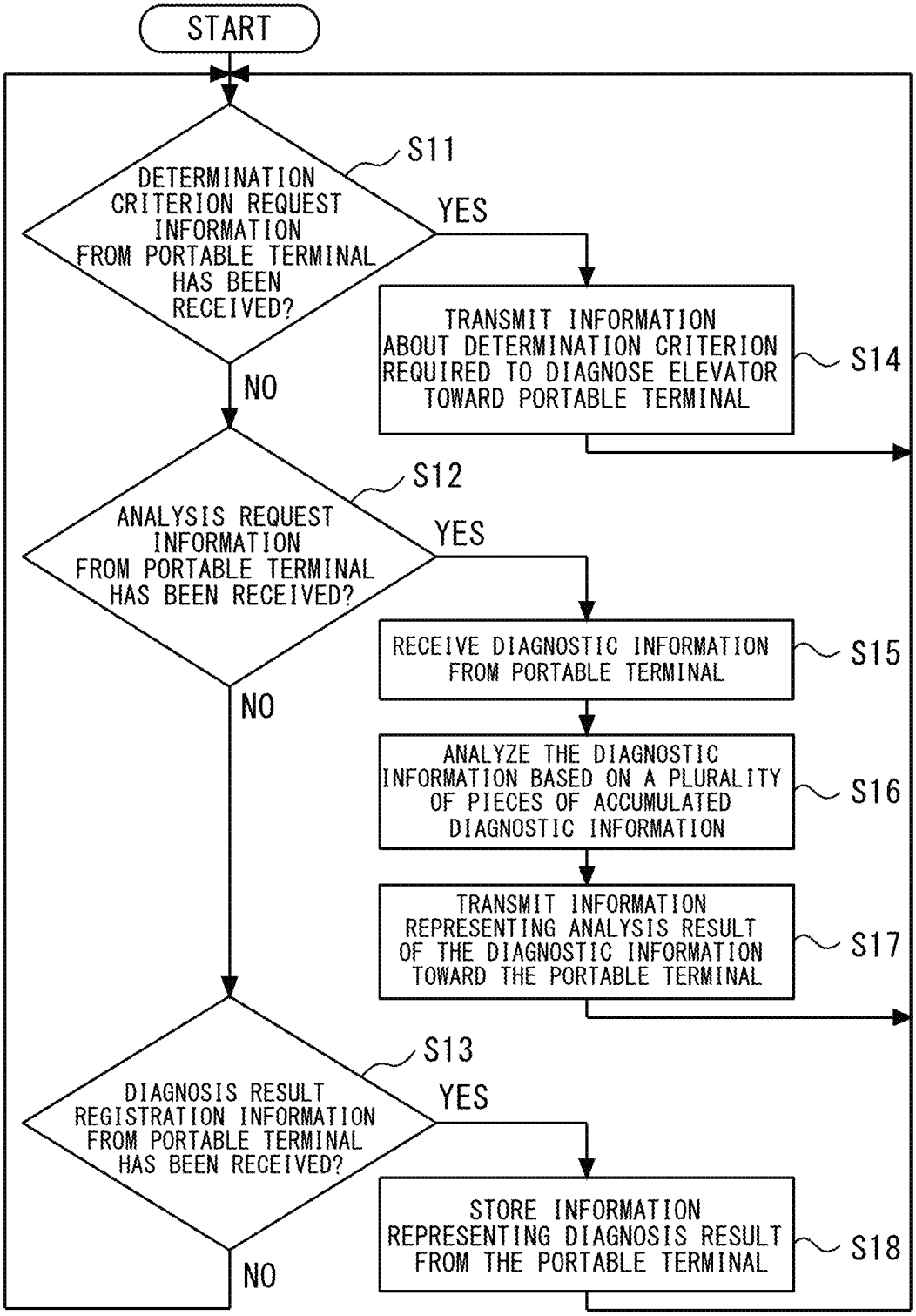
FIG. 6 is a flowchart for describing an outline of an operation of the diagnostic analysis device for vertical transportation devices in the embodiment 1.

FIG. 6 is a flowchart for describing the outline of the operation of the diagnostic analysis device for vertical transportation devices in the embodiment 1.

In step S11, the diagnostic analysis device 11 determines whether or not determination criterion request information from the portable terminal 12 has been received.

If the determination criterion request information from the portable terminal 12 has not been received in step S11, the diagnostic analysis device 11 performs an operation in step S12. In step S12, the diagnostic analysis device 11 determines whether or not analysis request information from the portable terminal 12 has been received.

If the analysis request information from the portable terminal 12 has not been received in step S12, the diagnostic analysis device 11 performs an operation in step S13.

In step S13, the diagnostic analysis device 11 determines whether or not diagnosis result registration information from the portable terminal 12 has been received.

If the diagnosis result registration information from the portable terminal 12 has not been received in step S13, the diagnostic analysis device 11 performs an operation in step S11.

If the determination criterion request information from the portable terminal 12 has been received in step S11, the diagnostic analysis device 11 performs an operation in step S14. In step S14, the diagnostic analysis device 11 transmits information about a determination criterion required to diagnose the elevator toward the portable terminal 12. Then, the diagnostic analysis device 11 performs the operation in step S11.

If the analysis request information from the portable terminal 12 has been received in step S12, the diagnostic analysis device 11 performs an operation in step S15. In step S15, the diagnostic analysis device 11 receives diagnostic information from the portable terminal 12. Then, the diagnostic analysis device 11 performs an operation in step S16. In step S16, the diagnostic analysis device 11 analyzes the diagnostic information based on a plurality of pieces of accumulated diagnostic information. Then, the diagnostic analysis device 11 performs an operation in step S17. In step S17, the diagnostic analysis device 11 transmits information representing an analysis result of the diagnostic information toward the portable terminal 12. Then, the diagnostic analysis device 11 performs the operation in step S11.

If the diagnoses result registration information from the portable terminal 12 has been received in step S13, the diagnostic analysis device 11 performs an operation in step S18. In step S18, the diagnostic analysis device 11 accumulates information representing a diagnosis result from the portable terminal 12. Then, the diagnostic analysis device 11 performs the operation in step S11.

According to the embodiment 1 described above, the portable terminal 12 stores the information about the acceleration in the vertical direction and the acceleration in the horizontal direction at the time of a diagnosis operation of the elevator in association with information about a detection timing. Accordingly, information for appropriately diagnosing the elevator can be obtained. As a result, a work time period at the time of troubleshooting can be reduced.

The portable terminal 12 stores information corresponding to a sound around the car 6 in association with the information about the detection timing. Accordingly, information for more appropriately diagnosing the elevator can be obtained.

The portable terminal 12 stores information about a rotation angle of the housing unit 12*a* in association with the information about the detection timing. Accordingly, information for more appropriately diagnosing the elevator can be obtained.

The portable terminal 12 stores image information around the housing unit 12*a* in association with information about a shooting timing. Accordingly, information for more appropriately diagnosing the elevator can be obtained.

The portable terminal 12 determines a direction of the housing unit 12*a* relative to the car 6 based on the image information around the housing unit 12*a*. Accordingly, information for more appropriately diagnosing the elevator can be obtained.

The portable terminal 12 displays information about a position in the vertical direction of the car 6 obtained from the information about the acceleration in the vertical direction and other diagnostic information in association with each other. Accordingly, an abnormal portion of the elevator can be appropriately estimated.

The portable terminal 12 transmits diagnostic information of the car 6 toward the diagnostic analysis device 11. Accordingly, in the diagnostic analysis device 11, more detailed diagnosis can be performed while suppressing incomplete troubleshooting due to insufficient recording.

The diagnostic analysis device 11 analyzes current diagnostic information based on the accumulated diagnostic information. Accordingly, the elevator can be more accurately diagnosed.

The diagnostic analysis device 11 transmits information representing an analysis result toward the portable terminal 12. Accordingly, a detailed diagnosis result can be presented to the maintenance person. Accordingly, appropriate diagnosis can be performed without relying on a skill of the maintenance person.

A device having a function similar to that of the portable terminal 12 may be permanently installed in the car 6. In this case, information for diagnosing the elevator can be obtained at the time of a normal operation of the elevator, for example.

An abnormal portion may be estimated by inputting respective values of an outer diameter of a sheave of the traction machine 4, an outer diameter of a suspension sheave of the car 6, and an outer diameter of a suspension sheave of the counter weight 7, a span of a guide rail of the car 6 and a span of a guide rail of the counter weight 7, and the like into the portable terminal 12 and comparing a pattern corresponding to diagnostic information obtained from the values with a pattern corresponding to actual diagnostic information. In this case, a portion to be maintained can be promptly identified.

The diagnostic method according to the embodiment 1 may be applied to an elevator including no machine room 2 but including a traction machine 4, a control device 8, and a monitoring device 9 each provided in an upper portion or a lower portion of the shaft 1.

A device having a function similar to that of the portable terminal 12 may be applied to a moving object in a vertical transportation device other than an elevator.

For example, a device having the function similar to that of the portable terminal 12 may be applied to a step of a passenger conveyor. In this case, if a step chain, which moves the step with a device having the function similar to that of the portable terminal 12 attached to the step, is driven, elongation of the step chain can be detected from obtained acceleration.

For example, a device having the function similar to that of the portable terminal 12 may be applied to a moving handrail of a passenger conveyor. In this case, if a handrail chain, which moves the moving handrail with the device having the function similar to that of the portable terminal 12 attached to the moving handrail, is driven, elongation of the moving handrail chain can be detected from obtained acceleration.

Then, an example of the diagnostic analysis device 11 will be described with reference to FIG. 7.

Figure 7:
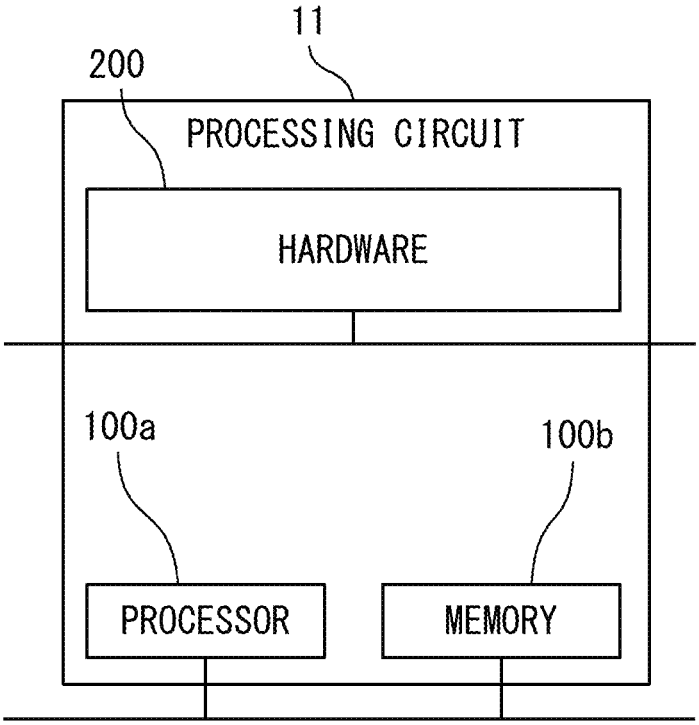
FIG. 7 is a block diagram of hardware of the diagnostic analysis device for vertical transportation devices in the embodiment 1.

FIG. 7 is a block diagram of hardware of the diagnostic analysis device for vertical transportation devices in the embodiment 1.

Each of functions of the diagnostic analysis device 11 can be implemented by a processing circuit. For example, the processing circuit includes at least one processor 100*a* and at least one memory 100*b*. For example, the processing circuit includes at least one piece of dedicated hardware 200.

If the processing circuit includes the at least one processor 100*a* and the at least one memory 100*b*, each of the functions of the diagnostic analysis device 11 is implemented by software, firmware, or a combination of software and firmware. At least one of the software and the firmware is described as a program. At least one of the software and the firmware is stored in the at least one memory 100*b*. The at least one processor 100*a* reads out and executes the program stored in the at least one memory 100*b*, to implement each of the functions of the diagnostic analysis device 11. The at least one processor 100*a* is also referred to as a central processing unit, a processing device, an arithmetic device, a microprocessor, a microcomputer, or a DSP. Examples of the at least one memory 100*b* include non-volatile or volatile semiconductor memories such as a RAM, a ROM, a flash memory, an EPROM, and an EEPROM, a magnetic disk, a flexible disk, an optical disk, a compact disk, a mini disk, and a DVD.

If the processing circuit includes at least one piece of dedicated hardware 200, the processing circuit is implemented by a single circuit, a composite circuit, a programmed processor, a processor programmed in parallel, an ASIC, an FPGA, or a combination of any of these, for example. For example, each of the functions of the diagnostic analysis device 11 is implemented by the processing circuit. For example, the functions of the diagnostic analysis device 11 are collectively implemented by the processing circuit.

Some of the functions of the diagnostic analysis device 11 may be implemented by dedicated hardware 200, or others may be implemented by software or firmware. For example, a function of the analysis-side control unit 11*e* may be implemented by a processing circuit as dedicated hardware 200, and functions other than the function of the analysis-side control unit 11*e* may be implemented by the at least one processor 100*a* reading out and executing the program stored in the at least one memory 100*b*.

Thus, the processing circuit implements each of the functions of the diagnostic analysis device 11 by hardware 200, software, firmware, or a combination of any of these.

Each of functions of the control device 8 is also implemented by a processing circuit similar to the processing circuit that implements each of the functions of the diagnostic analysis device 11, although not illustrated. Each of functions of the monitoring device 9 is also implemented by a processing circuit similar to the processing circuit that implements each of the functions of the diagnostic analysis device 11. Each of functions of the information center device 10 is also implemented by a processing circuit similar to the processing circuit that implements each of the functions of the diagnostic analysis device 11.

INDUSTRIAL APPLICABILITY

As described above, a diagnostic device and a diagnostic analysis device for vertical transportation devices according to the present disclosure can be used for an elevator system.

REFERENCE SIGNS LIST

1 Shaft
2 Machine room
3 Hall
4 Traction machine
5 Main rope
6 Car
7 Counter weight
8 Control device
9 Monitoring device
10 Information center device
11 Diagnostic analysis device
11*a* Analysis-side reception unit (Analysis-side receiver)
11*b* Analysis-side transmission unit (Analysis-side transmitter)
11*c* Accumulation unit (Accumulator)
11*d* Analysis unit (Analyzer)
11*e* Analysis-side control unit (Analysis-side controller)
12 Portable terminal
12*a* Housing unit (Housing)
12*b* Storage unit (Storage)
12*c* Diagnosis-side reception unit (Diagnosis-side receiver)
12*d* Diagnosis-side transmission unit (Diagnosis-side transmitter)
12*e* Display unit (Display)
12*f* Acceleration detection unit (Acceleration detector)
12*g* Microphone unit (Microphone)
12*h* Rotation angle detection unit (Rotation angle detector)
12*i* Camera unit (Camera)
12*j* Position detection unit (Position detector)
12*k* Diagnosis-side control unit (Diagnosis-side controller)
100*a* Processor
100*b* Memory
200 Hardware

The invention claimed is:

1. A diagnostic device for vertical transportation devices, comprising:

a housing defining an outer profile;

a display housed in the housing and configured to display information;

a storage housed in the housing and configured to store information;

an acceleration detector housed in the housing and configured to detect, with the housing temporarily attached to a moving object in a vertical transportation device, acceleration in a vertical direction and acceleration in a horizontal direction of the moving object as diagnostic information of the moving object in the vertical transportation device when the moving object has moved;

a camera housed in the housing and configured to shoot an outside of the moving object in the vertical transportation device as diagnostic information of the moving object in the vertical transportation device with the housing temporarily attached to the moving object; and a diagnosis-side controller housed in the housing and configured to cause the storage to store information about the acceleration in the vertical direction and information about the acceleration in the horizontal direction, which have been detected by the acceleration detector, in association with information about a detection timing, and wherein the diagnosis-side controller is configured to cause the storage to store information about an image shot by the camera in association with information about a shooting timing, and the housing is configured to be temporarily attached to the moving object during a test operation of the moving object, and the housing is configured to be detached from the moving object and the display displays the information including a diagnosis result of the test operation wherein the diagnosis-side controller is configured to determine an orientation direction of the housing relative to the moving object in the vertical transportation device based on the information about the image shot by the camera.

2. The diagnostic device for vertical transportation devices according to claim 1, further comprising:

a microphone housed in the housing and configured to collect a sound around the moving object in the vertical transportation device as diagnostic information of the moving object in the vertical transportation device with the housing attached to the moving object, wherein the diagnosis-side controller is configured to cause the storage to store information corresponding to the sound detected by the microphone in association with information about a detection timing.

3. The diagnostic device for vertical transportation devices according to claim 1, further comprising:

a rotation angle detector housed in the housing and configured to detect a rotation angle of the moving object in the vertical transportation device as diagnostic information of the moving object in the vertical transportation device with the housing attached to the moving object, wherein the diagnosis-side controller is configured to cause the storage to store information about the rotation angle detected by the rotation angle detector in association with information about a detection timing.

4. The diagnostic device for vertical transportation devices according to claim 1, further comprising:

a position detector housed in the housing and configured to detect a position of the vertical transportation device by a function of a global positioning system with the housing attached to the moving object in the vertical transportation device, wherein the diagnosis-side controller is configured to set a standard when diagnosing diagnostic information of the moving object in the vertical transportation device based on information about the position detected by the position detector.

5. The diagnostic device for vertical transportation devices according to claim 1, further comprising:

wherein the diagnosis-side controller is configured to cause the display to display information about a position in the vertical direction of the moving object obtained from the information about the acceleration in the vertical direction detected by the acceleration detector and other diagnostic information in association with each other.

6. The diagnostic device for vertical transportation devices according to claim 1, further comprising:

a diagnosis-side transmitter housed in the housing and configured to transmit information, wherein the diagnosis-side controller is configured to cause the diagnosis-side transmitter to transmit diagnostic information of the moving object in the vertical transportation device.

7. A diagnostic analysis device for vertical transportation devices, comprising:

an analysis-side receiver configured to receive information;

an accumulator configured to accumulate information; and an analyzer configured to cause, when the analysis-side receiver receives diagnostic information from the diagnostic device according to claim 6, the accumulator to accumulate the diagnostic information and to analyze diagnostic information of a moving object in a vertical transportation device based on the accumulated diagnostic information.

8. The diagnostic analysis device for vertical transportation devices according to claim 7, further comprising:

an analysis-side controller configured to resample, when the analysis-side receiver receives diagnostic information from the diagnostic device, the diagnostic information and to cause the accumulator to accumulate the resampled diagnostic information.

9. The diagnostic analysis device for vertical transportation devices according to claim 7, further comprising:

an analysis-side transmitter configured to transmit information, and a controller configured to cause the analysis-side transmitter to transmit information representing an analysis result by the analyzer toward the diagnostic device.

10. A diagnostic device for vertical transportation devices, comprising:

a housing defining an outer profile;

a storage housed in the housing and configured to store information;

an acceleration detector housed in the housing and configured to detect, with the housing attached to a moving object in a vertical transportation device, acceleration in a vertical direction and acceleration in a horizontal direction of the moving object as diagnostic information of the moving object in the vertical transportation device when the moving object has moved;

a camera housed in the housing and configured to shoot an outside of the moving object in the vertical transportation device as diagnostic information of the moving object in the vertical transportation device with the housing attached to the moving object; and a diagnosis-side controller housed in the housing and configured to cause the storage to store information about the acceleration in the vertical direction and information about the acceleration in the horizontal direction, which have been detected by the acceleration detector, in association with information about a detection timing, and wherein the diagnosis-side controller is configured to cause the storage to store information about an image shot by the camera in association with information about a shooting timing, and the diagnosis-side controller is configured to determine an orientation direction of the housing relative to the moving object in the vertical transportation device based on the information about the image shot by the camera.

* * * * *